United States Patent [19]

Krukowski

[11] Patent Number: 4,628,910

[45] Date of Patent: Dec. 16, 1986

[54] MUSCLE EXERCISE AND REHABILITATION APPARATUS

[75] Inventor: Richard Krukowski, Chatham, N.J.

[73] Assignee: Biodex Corporation, Shirley, N.Y.

[21] Appl. No.: 676,493

[22] Filed: Nov. 29, 1984

[51] Int. Cl.[4] ..... A63B 23/00

[52] U.S. Cl. ..... 128/25 R; 272/129; 272/DIG. 6

[58] Field of Search ..... 272/129, 130, 116, DIG. 5, 272/DIG. 6; 128/25 R, 256, 26, 363, 364

[56] References Cited

U.S. PATENT DOCUMENTS

| | | | |
|---|---|---|---|
| 3,744,480 | 7/1973 | Gause et al. | 272/129 |
| 3,848,467 | 11/1974 | Flavell . | |
| 3,869,121 | 3/1975 | Flavell . | |
| 4,184,678 | 1/1980 | Flavell et al. | 272/DIG. 6 |
| 4,333,340 | 6/1982 | Elmeskog . | |
| 4,407,496 | 10/1983 | Johnson . | |

*Primary Examiner*—Leo P. Picard
*Attorney, Agent, or Firm*—Stempler, Cobrin & Godsberg

[57] ABSTRACT

A muscle exercise and rehabilitation apparatus comprises a movable arm against which a force can be applied; a servo motor mechanically coupled to the arm through a gear reducer; a sensing device for sensing the force applied to the arm and for producing a load signal corresponding thereto; a tachometer for producing a velocity signal corresponding to the velocity of the arm; a closed loop velocity servo feedback circuit for controlling the motor in response to a control signal and the velocity signal so that the arm has a constant resistive torque applied thereto and/or has its velocity regulated, regardless of the force applied to the arm, the feedback circuit including an amplifier for amplifying the load signal to produce the control signal, a torque control circuit and a speed clamp circuit for modifying the control signal of the amplifier to produce a modified control signal, depending on the mode of operation; a switch for switching in at least one of the torque control circuit, the speed clamp circuit, an eccentric circuit which controls eccentric operation and an oscillator circuit, and a PWM amplifier for producing an error signal in response to the modified control signal and the velocity signal to control the motor to regulate the velocity of the arm and/or apply a constant resistive torque to the arm, for both extension and flexion, as well as concentric and eccentric operation, regardless of the force applied to the arm.

41 Claims, 5 Drawing Figures

FIG. 1
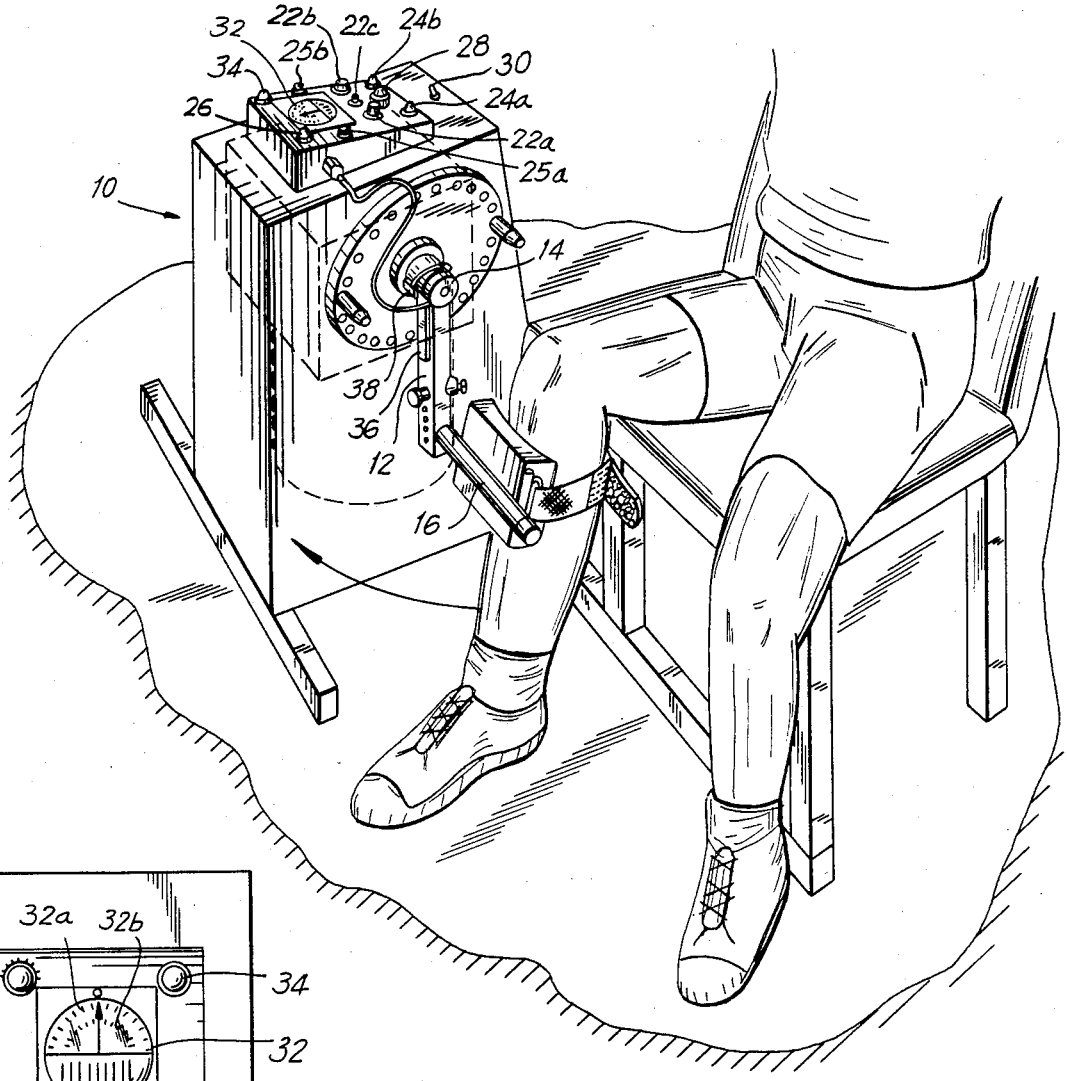
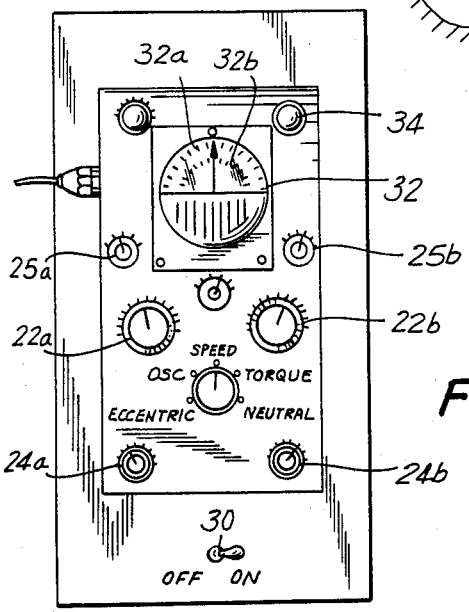
FIG. 2

MUSCLE EXERCISE AND REHABILITATION APPARATUS

BACKGROUND OF THE INVENTION

This invention relates generally to exercise and rehabilitation apparatus and, more particularly, is directed to exercise and rehabilitation apparatus operative in isokinetic, constant torque, neutral, oscillation and eccentric modes of operation.

Various exercising machines, such as those designated by "Universal", "Nautilus", "Cybex" and "Kin/-Com", are well known in the art.

One of the first of these machines was the "Universal" exercising machine which uses a pulley-weight system, whereby the weights added to the pulley system can be varied by the user. With such apparatus, however, there are no controls over the manner, that is, the speed of movement and the torque applied by the user, in overcoming the weight load. It is only necessary that the user apply a force that is greater than the weight load through the pulley system. As such, the "Universal" apparatus is similar to a free weight system.

The "Nautilus" apparatus was developed to overcome some of the deficiencies of the "Universal" machine by providing a fixed path of movement of the respective arms thereof so that the latter follow respective paths designed for better muscle isolation during exercise. The "Nautilus" apparatus, rather than using a pulley-weight system, uses a novel cam arrangement. However, as with the "Universal" machine, the "Nautilus" apparatus does not control the speed of movement or resistive torque applied to the arm.

The "Cybex" apparatus, as exemplified in U.S. Pat. No. 3,465,592, recognized that the muscle is not equally powerful throughout its entire range of motion. The "Cybex" apparatus provides a motor connected through a gearing system to regulate the exercise arm of the machine so that it travels with a constant velocity, thereby taking into account the different strengths of the muscle during different angular extensions thereof.

Although the "Cybex" apparatus provides distinct advantages over the aforementioned "Universal" and "Nautilus" apparatus, the "Cybex" apparatus fails to provide necessary functions for truly accurate and corrective exercise and rehabilitation. In this regard, the "Cybex" apparatus uses a motor with two clutches. The arm of the apparatus is movable freely until the planetary speed of the gearing therein is reached, whereupon an impact resistive force is met by the user. This impact resistive force, of course, is undesirable, particularly from a rehabilitation standpoint.

Further, with the "Cybex" apparatus, although a constant velocity operation is provided for both extension and flexion of a muscle, there is no provision for controlled movement for both concentric and eccentric motions. The "Cybex" apparatus also only provides for constant velocity motions.

U.S. Pat. No. 4,235,437 discloses a robotic exercise machine which uses a computer to regulate the motion of an exercise arm in response to software programmed into the machine and in response to the force applied to the arm by the user as detected by a strain gauge at the end of the arm. By means of hydraulic cylinders and solenoid controlled valves, movement of the arm can be accurately controlled. However, the equipment provided in U.S. Pat. No. 4,235,437 is relatively complicated and requires expensive computer equipment and a complex linkage system. Further, because the equipment is computer controlled, the user must spend some time programming the computer with the desired settings before exercising. This, of course, is time consuming and detracts from the exercising.

It is to be appreciated that, with muscle exercise and rehabilitation apparatus, it is necessary that movement of the arm be smooth in all modes of operation. A problem with computer controlled apparatus is that the computer must make various samplings and computations, and thereafter makes corrections that are necessary. Although computer time is generally considered fast, the amount of time necessary for the computer to perform such operations and then control the mechanical and hydraulic devices of the apparatus may not result in smooth movement of the exercise arm, particularly at small loads.

Further, with hydraulic systems, such as that shown in the above U.S. Patent, various problems of leakage, dirt in the servo valves, compliance in the hoses and pipes and heat dissipation result which detract from the accuracy of the system.

There is also known a muscle exercise and rehabilitation apparatus sold by Chattecx Corporation of Chattanooga, Tenn. under the name "Kin/Com" which provides a computer controlled hydraulic system which monitors and measures velocities, angles and forces during muscular contractions. A load cell is provided to measure the force at the point of application, with an accuracy of 4 ounces. However, this apparatus, being computer controlled, suffers from the same problems discussed above with respect to U.S. Pat. No. 4,235,437. It is further understood that the "Kin/Com" apparatus is eccentric in one motion only.

OBJECTS AND SUMMARY OF THE INVENTION

Accordingly, it is an object of the present invention to provide a novel, yet relatively simple, muscle exercise and rehabilitation apparatus.

More particularly, it is an object of the present invention to provide a muscle exercise and rehabilitation apparatus that can operate in an isokinetic, constant torque, neutral, oscillation or eccentric mode of operation.

It is another object of the present invention to provide a muscle exercise and rehabilitation apparatus that provides a closed loop velocity servo feedback system during each of the modes of operation to accurately control movement of the arm of the machine.

It is still another object of the present invention to provide a muscle exercise and rehabilitation apparatus that will respond in the isokinetic, constant torque and oscillation modes of operation for all forces applied to the arm of the apparatus in the range of 0–400 ft.-lbs.

It is yet another object of the present invention to provide a muscle exercise and rehabilitation apparatus that is relatively compact, inexpensive to manufacture and which utilizes greatly simplified circuitry.

In accordance with an aspect of the present invention, a muscle exercise and rehabilitation apparatus includes movable arm means against which a force can be applied; servo motor means mechanically coupled to the arm means; sensing means for sensing the force applied to the arm means and for producing a load signal corresponding thereto; tachometer means for producing a velocity signal corresponding to the velocity of the arm means; and closed loop velocity servo feedback means for controlling the motor means in response to the load signal and the velocity signal to at least one of provide a constant torque to and regulate the velocity of the arm means, regardless of the force applied to the arm means.

In accordance with a further aspect of the present invention, the apparatus is also operative in an oscillatory mode and a neutral mode.

The present invention is also operative and independently controllable for both flexion and extension, as well as during concentric and eccentric operations.

The above, and other, objects, features and advantages of the present invention will become readily apparent from the following detailed description thereof which is to be read in connection with the accompanying drawings.

BRIEF DESCRIPTION OF THE DRAWINGS

FIG. 1 is a perspective view of a muscle exercise and rehabilitation apparatus according to one embodiment of the present invention;

FIG. 2 is a top plan view of the control panel of the apparatus of FIG. 1;

DETAILED DESCRIPTION OF A PREFERRED EMBODIMENT

Figure 3:
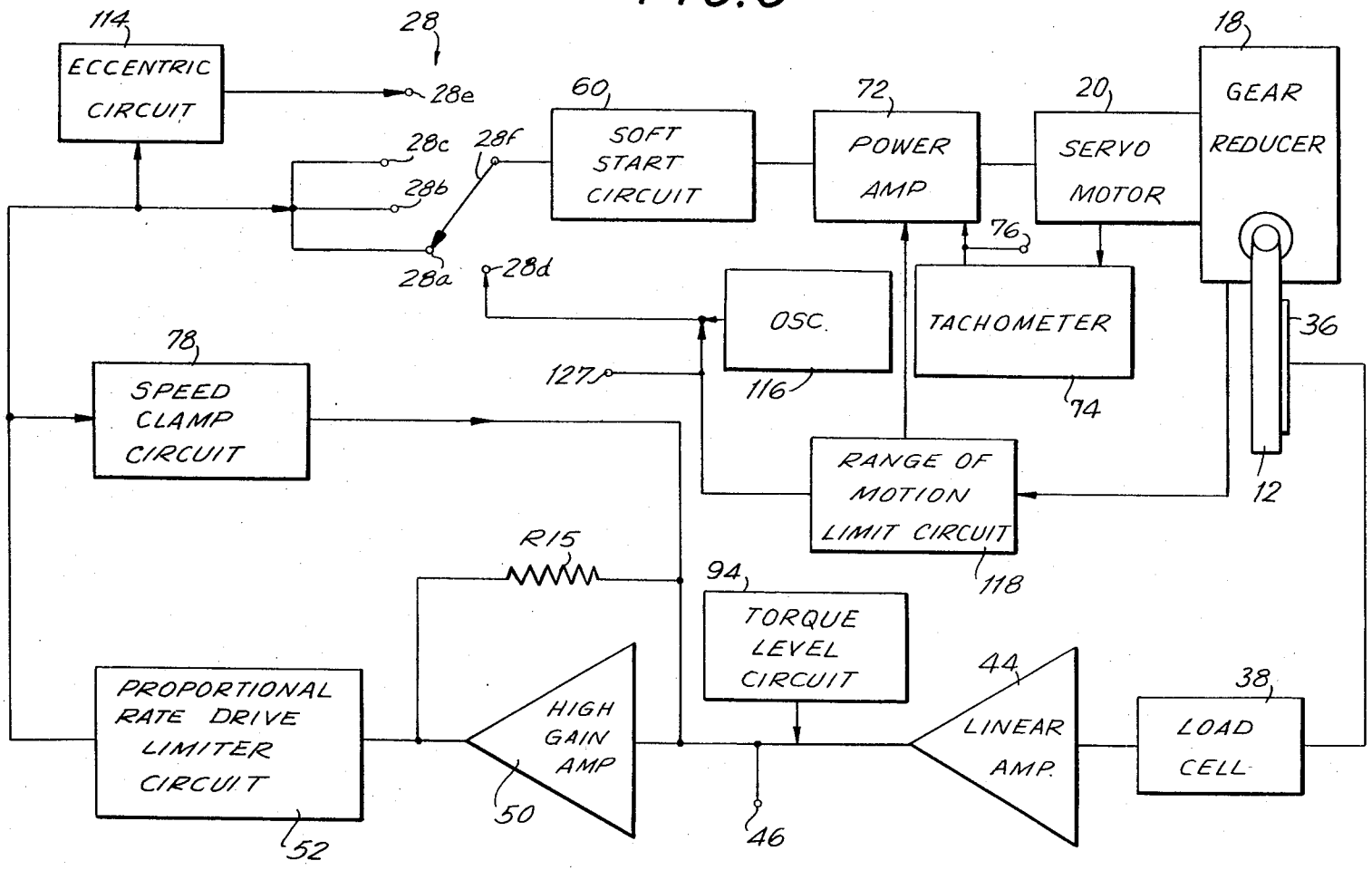
FIG. 3 is a block diagram of the circuitry and elements of the apparatus of FIG. 1.

Referring to the drawings in detail, and initially to FIG. 1 thereof, a muscle exercise and rehabilitation apparatus 10 according to one embodiment of the present invention includes an arm 12 having a first proximal end secured to a shaft 14 and a distal or free end having a handle 16 to which the user applies a force for muscle exercise and/or rehabilitation.

Shaft 14 on which arm 12 is mounted has a gear (not shown) thereon in meshing engagement with the gears of a gear reducer 18, for example, having a gear reduction ratio of 60:1, such as a Winsmith 60:1 gear box, and which, in turn, is driven by the output shaft of a servo motor 20. As will be explained hereinafter in greater detail, servo motor 20 is controlled to regulate movement of arm 12 through gear reducer 18.

In accordance with the present invention, feedback means is provided by which the force applied by the user against arm 12 is sensed and, through appropriate circuitry thereof, servo motor 20 is controlled to, in turn, control movement of arm 12 so that the apparatus operates in a regulated velocity or isokinetic (concentric or eccentric), constant torque, neutral or oscillation mode, regardless of the force applied to arm 12 by the user.

In the isokinetic mode of operation, regardless of the force applied by the user, servo motor 20 is driven at a velocity dependent upon the force applied by the user. Once a predetermined clamp velocity is reached, the velocity of arm 12 is prevented from exceeding the preset velocity and is maintained at such velocity. The isokinetic mode for arm 12 is operative in both directions for extension and flexion during a single exercise, as well as for concentric muscular contractons where the arm is controlled to move with a regulated velocity in the direction of the force applied by the user and in a second, eccentric mode where the arm is controlled to move with a regulated velocity in a direction opposite to the direction of force applied by the user. In the concentric mode, the speed of movement of arm 12 can be independently adjusted for each direction by speed adjustment knobs **22*a* and 22*b* thereby operative for both extension and flexion of the muscle. For eccentric operation, arm 12 is controlled for extension and flexion by the same value set by adjustment knob 22*c***.

A third mode of operation with which the present invention can be used is a constant torque mode of operation in which a constant reverse torque is applied against arm 12. In this mode of operation, the user must overcome an initial resistive torque, and thereafter, the resistive torque is maintained constant and the user can move the arm with any applied force, and thereby at a speed determined by the applied force. The resistive torque can be independently varied by torque adjustment knobs **24*a* and 24*b* shown in FIG. 2** for both extension and flexion of the muscle. Torque control is also effective in the eccentric mode of operation, and although variable, is generally factory set.

A fourth mode of operation with which the present invention can be used is the oscillation mode in which arm 12 is caused to oscillate at a regulated velocity, regardless of the force applied thereto. In this mode, the oscillation signal is controlled by an adjustable knob 26 of the apparatus. The apparatus is operative in this mode for extension and flexion.

The fifth mode of operation with which the present invention can be used is the neutral mode whereby the arm moves or swings readily with minimum force applied thereto by the user.

A five way mode switch 28 is provided to select the desired mode of operation, namely, the concentric isokinetic, constant torque or oscillation modes of operation, the eccentric mode of operation, and the neutral mode of operation, as will be explained in greater detail hereinafter. In addition, an ON/OFF switch 30 is provided for the entire apparatus.

The various outputs during the different modes of operation may be monitored by any suitable means, for example, a meter 32 having different scales **32*a* and 32*b* for the different modes of operation. Alternatively, an output measurement of the device can be obtained from an external terminal 34** to a bar graph or other similar measuring apparatus. For example, during the constant torque mode of operation, an output of applied torque by the user versus speed of movement of the arm can be obtained.

In accordance with the present invention, a closed loop velocity servo feedback circuit is used in each of the different modes of operation to provide a closed loop servo system which has a linear response for both small and large applied loads, for example, in the range of 0–400 ft.-lbs. of torque applied to arm 12 and which is accurate for even minimal forces of, for example, a few ounces, applied to arm 12.

Figure 4:
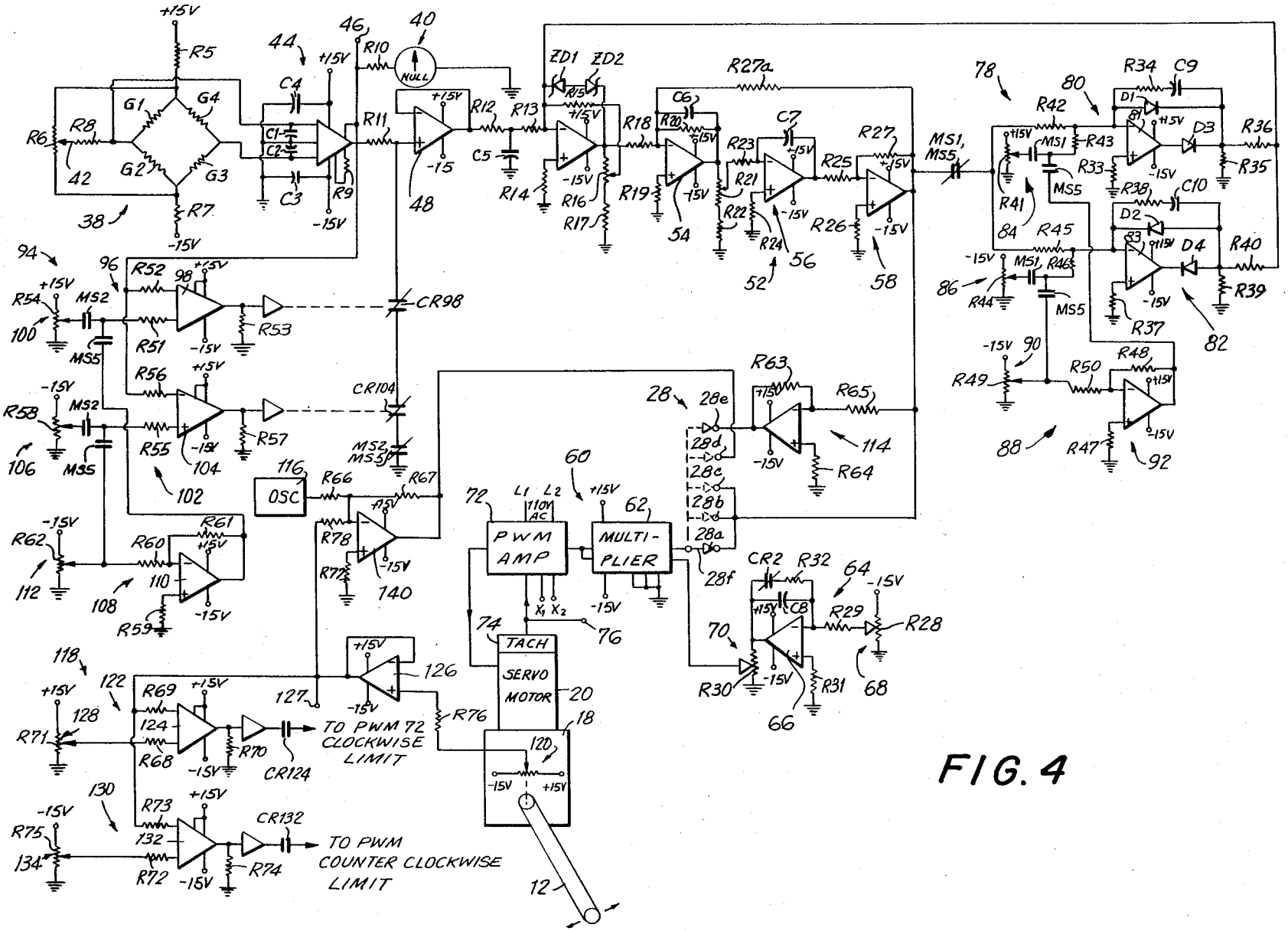
FIG. 4 is a detailed circuit wiring diagram of the circuitry of FIG. 3.

As shown in FIG. 3, a strain gauge 36 is mounted on arm 12 and, in accordance with the force applied by the user to arm 12, produces an output signal indicative of such load. This signal is supplied to a load cell 38 which, as shown in FIG. 1, is ideally located on arm 12 adjacent strain gauge 36. As shown in FIG. 4, load cell 38 is formed of strain gauges G1–G4 connected in a diamond or bridge configuration with the junction between gauges G1 and G4 being connected to a voltage source of, for example, +15 V, through a resistor R5 and also to one end of a resistor R6 which forms part of a null potentiometer. The junction between gauges G2 and G3 is connected to a negative voltage source of, for example, −15 V, through a resistor R7 and to the other end of resistor R6. The junction between gauges G1 and G2 is connected to a movable wiper arm 42 of the potentometer through a resistor R8. The junction of gauges G1 and G2 and the junction of gauges G3 and G4 form the outputs of the load cell and are supplied to respective input terminals of a linear amplifier 44. Wiper arm 42 is manually controlled so that the reading on a null meter 40 at the output of linear amplifier 44 is zero when zero force is applied to arm 12. Thus, the null potentiometer is used to control the output of linear amplifier 44 to equal zero for zero force on the arm.

Linear amplifier 44, in response to the signals from load cell 38, produces a signal, for example, having a voltage level in the range of 0–10 V which is linearly related to the torque applied to arm 12 in the range of 0–400 ft.-lbs. Preferably, the capacitors used with amplifier 44 are of the ceramic dip type, and amplifier 44 may be an AD524 amplifier. The output of amplifier 44 is supplied to a torque output terminal 46 from which a reading of the applied load or torque to arm 12 can be measured.

The output from amplifier 44 is also supplied through a unity gain amplifier 48, which provides a high impedance input, to a high gain amplifier 50 which produces an output signal in response to the output signal from amplifier 44 such that, for example, 0.5 pounds of force applied to arm 12 is represented by 10 volts at the output of high gain amplifier 50, that is, the voltage level rises quickly to 10 volts and then amplifier 48 becomes saturated thereafter so that for higher loads, the output becomes saturated at 10 volts. The Zener diodes ZD1 and ZD2 connected as part of amplifier 50 may, for example, be of the type 1N4739A or the equivalent.

The output of high gain amplifier 50 is supplied to a proportional rate drive limiter circuit 52 which is designed to prevent undesirable oscillations or overshoots in the servo circuit, that is, which stabilizes the circuit in the servo loop. As shown in FIG. 4, proportional rate drive limiter circuit 52 is formed by three cascaded amplifiers: a high gain amplifier 54, followed by an integrator 56 and then by an inverting amplifier 58.

The output from proportional rate drive limiter circuit 52, that is, the output of inverting amplifier 58, is supplied to the aforementioned five position mode switch 28. The five positions or terminals 28*a*–28*e* of switch 28 correspond to the concentric isokinetic, concentric torque, neutral, oscillation and eccentric modes of operation, respectively, which are contacted by movable arm 28*f* of switch 28.

It is to be appreciated that, in the arrangement shown in FIG. 4, switch 28 is positioned in its isokinetic position so that the concentric angular velocity of arm 12 is regulated.

The output of switch 28 is supplied to a soft start circuit 60 including a multiplier circuit 62, such as an AD534 amplifier, that provides a ramp function to prevent sudden or abrupt changes due to transient input signals. More particularly, multiplier circuit 62 provides for multiplicaton of the signal supplied thereto by a ramp signal to obtain a steady increase in the output signal and to thereby prevent sudden or abrupt changes in this signal.

A multiplier control circuit 64 controls the voltage level and time period of the ramp function imparted by multiplier circuit 62, and particularly, includes an amplifier 66 having its negative input supplied with a voltage dependent upon an input potentiometer 68 which controls the ramp time of the ramp signal. A second potentiometer 70 at the output of amplifier 66 controls the ramp voltage of the ramp signal. In addition, a contact CR2 is connected in series with a feedback resistor R32 of amplifier 66, and is normally closed, but opens when the machine is started, so as to short out the capacitor C8 so as to provide an initial zero setting.

Multiplier circuit 62 is a unity gain multiplier so that the maximum voltage supplied thereto from multiplier control circuit 64 is never greater than the maximum voltage supplied thereto from switch 28.

The output signal from multiplier circuit 62 is a load signal which is proportional to the load detected by strain guage 36 and is applied to a power amplifier 72 which, in turn, controls servo motor 20. Preferably, power amplifier 74 is a pulse width modulated (PWM) amplifier, such as a Glentek 3466-2. The servo motor 20, which may be an EGG Motor 5350, as aforementioned, controls movement of arm 12 through gear reducer 18.

Servo motor 20 provides an output signal corresponding to the angular velocity of the output shaft therefrom to a tachometer 74 which, in turn, supplies a velocity signal to another input of power amplifier 72. Power amplifier 72 thereby produces an error signal which is supplied to servo motor 20 to control the latter in response to the velocity signal from tachometer 74 and the load or control signal from multiplier circuit 62. Power amplifier 72 thereby functions as a velocity servo control whereby the load signal functions as a control signal, the velocity signal functions as a feedback signal and the error signal is generally proportional to the control signal.

As with the torque output signal at terminal 46, the velocity output signal from tachometer 74 is supplied to an output terminal 76 from which a reading of the velocity of arm 12 can be measured.

The above circuitry constitutes the basic servo control circuitry according the present invention.

In accordance with the present invention, in order to control the angular speed of arm 12, a speed clamp circuit 78 is connected in parallel with the series combination of feedback resistor R15 and proportional rate drive limiter circuit 52 and provides a clockwise speed clamp setting and a counterclockwise speed clamp setting operation. More particularly, the output from inverting amplifier 58 is supplied to a clockwise clamp circuit 80 and a counterclockwise clamp circuit 82 which limits the speed of movement of arm 12 in both directions for concentric and eccentric movements.

The voltage clamp limits for circuits 80 and 82 are set by respective potentiometers 84 and 86 for concentric isokinetic operation which, in turn, are set by speed adjustment knobs 22*a* and 22*b*, respectively. In like manner, the voltage clamp limits for circuits 80 and 82 for the eccentric mode of operation are the same and are set by an eccentric control circuit 88 comprised of a potentiometer 90 for controlling the voltage to the negative input of the amplifier 83 of counterclockwise clamp circuit 82, and which also controls the voltage level to the negative input of an inverting amplifier 92 of eccentric control circuit 88 which, in turn, produces an inverted signal for controlling the voltage to the negative input of the amplifier 81 of clockwise clamp circuit 80.

In order to provide that potentiometers 84 and 86 are operative for controlling clamp circuits 80 and 82, respectively, during the concentric isokinetic mode of operation only, a mode switch contact MS1 is connected between potentiometer 84 and amplifier 81 of clockwise clamp circuit 80, and between potentiometer 86 and amplifier 83 of counterclockwise clamp circuit 82. Mode switch contacts MS1 are closed in response to arm 28*f* of mode switch 28 contacting terminal 28*a* thereof in the concentric isokinetic mode, and are open at all other times.

In like manner, eccentric control circuit 88 is connected to each of clamp circuits 80 and 82 through a mode switch contact MS5 which is closed only when arm 28*f* contacts terminal 28*e* to place the system in the eccentric mode of operation.

With the arrangement of speed clamp circuit 78 as shown in FIG. 4, as the output signal from inverting amplifier 58 becomes too large so as to exceed a predetermined maximum speed in the clockwise or counterclockwise direction as set by potentiometers 84 and 86, respectively, or by eccentric control circuit 88, the resistance of speed clamp circuit 78 in parallel with resistor R15 results in a lowering of the gain of amplifier 50 to prevent a speed buildup past the maximum set speeds, thereby maintaining movement of arm 12 at a constant speed. For example, during clockwise movement of arm 12 in the concentric mode, if resistor R15 of high gain amplifier has a resistance of 1OOK and resistor R36 of clockwise clamp circuit 80 has a resistance of 4.9K, when the load applied to arm 12 would result in the speed of movement of arm 12 exceeding the limit set by potentiometer 84, resistor R36 is effectively placed in parallel with resistor R15 to vary the feedback resistance of high gain amplifier 50 and to thereby reduce the gain thereof.

Preferably, speed clamp circuit 78 controls the angular speed of arm 12 in the concentric isokinetic mode in the range of 0–400 degrees/second. In the eccentric mode, on the other hand, because the arm is caused to move with a constant speed in a direction opposite to the application of force by the user, the range of speeds is, of course, much smaller, for example, in the range of 0–50 degrees/second.

In order to provide that speed clamp circuit 78 is operative only in the concentric isokinetic and eccentric modes of operation, a mode switch contact MS1, MS5 is connected between proportional rate drive limiter circuit 52 and speed clamp circuit 78, and is closed only when movable arm 28*f* of mode switch 28 contacts terminal 28*a* or 28*e*. Thus, speed clamp circuit 78 is effectively removed from the circuitry of FIG. 4 during the torque, neutral and oscillation modes of operation.

Accordingly, in the concentric isokinetic mode of operation, load cell 38 produces a signal corresponding to the load applied to arm 12 in response to the output of strain gauge 36 and which is supplied to linear amplifier 44. The latter amplifier 44, in turn, supplies an input signal to high gain amplifier 50, which supplies a high gain amplified signal to proportional rate drive limiter circuit 52 to prevent servo fluctuations or oscillations. This output signal is fed back to high gain amplifier 50 through the speed clamp circuit 78 by which the speed of movement of arm 12 is prevented from exceeding a predetermined speed set by potentiometers 84 and 86 through control knobs 22*a* and 22*b*, respectively. The output from proportional rate drive limiter circuit 52 is also supplied through terminal 28*a* and movable arm 28*f* of switch 28 to soft start circuit 60. The output signal from the latter circuit consititutes a load or control signal which is supplied to one input of power amplifier 72. Another input of power amplifier 72 is supplied with the velocity feedback signal from tachometer 72 to produce an error signal which is pulse width modulated and amplified in power amplifier 74. The output from amplifier 72 is used to control servo motor 20 to drive arm 12 in accordance with the force applied to arm 12 for speeds below the clamp speed, and to limit the movement of arm 12 to the clamp speed for large loads applied to arm 12. Of course, the direction of control is in the direction of the force applied by the user, for both extension and flexion.

In the constant torque mode of operation, movable arm 28*f* of switch 28 contacts terminal 28*b* whereby speed clamp circuit 78 is effectively removed from the circuitry, that is, since mode switches MS1, MS3 and MS5 are open at the input of speed clamp circuit 78.

To provide a constant torque, a torque control circuit 94 is provided at the input of unity gain amplifier 48, which controls arm 12 to move with a constant resistive torque. Torque control circuit includes a clockwise torque level circuit 96 which controls the torque in the clockwise concentric movement of arm 12, and which includes an amplifier 98 supplied at one input with the output signal from linear amplifier 44 and supplied at its other input with a voltage controlled by a potentiometer 100. In like manner, a counterclockwise torque level circuit 102 which controls the torque in the counterclockwise concentric movement of arm 12 includes an amplifier 104 supplied at one input with the output signal from linear amplifier 44 and supplied at its other input with a voltage controlled by a potentiometer 106. Amplifiers 98 and 104 may be type 311 amplifiers.

The outputs from amplifiers 98 and 104 control the operation of contacts CR98 and CR104, respectively, which are connected in series between ground and the positive input of unity gain amplifier 48. A mode switch contact MS2 (MS5) is also connected in series with contacts CR98 and CR104, and is closed in response to actuation of switch 28 during the torque and eccentric modes of operation, but is open at all other times.

As discussed previously, in the constant torque mode of operation, the user must overcome a threshold resistive torque, and thereafter, the resistive torque is maintained constant and the user can move the arm with any applied force, and thereby at a speed determined by the applied force. When the threshold resistive torque has not been overcome, contacts CR98 and CR104 are maintained closed. As a result, the entire signal from linear amplifier 44 flows directly to ground, whereby the arm is prevented from moving. When the threshold resistive torque, for example, for clockwise concentric movement, is overcome, amplifier 98 produces a signal to open contact CR98. As a result, the output signal from linear amplifier 44 is fed directly through unity gain amplifier 48 to high gain amplifier 50, whereby the arm is allowed to move freely as long as the force necessary to overcome the threshold force is maintained. In this manner, concentric torque control is effected.

During the eccentric mode of operation, some torque control is also effected. However, because the arm is moving in a direction opposite to the force applied by the user, there is only a minimal value of the setting for torque control, such as 0.5 ft.-lbs., as opposed to a greater range for the concentric torque mode. Although this minimal value can be changed, it is generally factory set. Accordingly, an eccentric torque level circuit 108 is provided and includes an amplifier 110 having its negative input supplied with a voltage controlled by a potentiometer 112. The voltage from potentiometer 112 is supplied to one input of amplifier 104, and the output of amplifier 110 is supplied to one input of amplifier 98. Torque control in the eccentric mode is accomplished in the same manner as that described above in the concentric torque mode. Thus, as long as the minimal set force is overcome, the signal passes from linear amplifier 44 to high gain amplifier 50.

For separating the operation of torque control circuit 94 in the concentric torque and eccentric modes of operation, a mode switch contact MS2 is connected between potentiometer 100 and amplifier 98, and between potentiometer 106 and amplifier 104. A mode switch contact MS5 is also connected between potentiometer 112 and amplifier 104, and between the output of amplifier 110 and the input of amplifier 98. Accordingly, when switch 28 is connected to terminal **28*b* in the concentric torque mode, mode switch contacts MS2 are closed and mode switch contacts MS5 are open, whereby potentiometers 100 and 106 control the torque operation. On the other hand, when switch 28 is connected to terminal 28*e* in the eccentric mode, mode switch contacts MS5 are closed and mode switch contacts MS2 are open, whereby potentiometer 112 controls the torque operation. It is to be remembered that, at the latter time, speed clamp circuit 78** is also operative.

Thus, in the concentric torque mode, control knobs **24*a* and 24*b* set potentiometers 100 and 106, which thereby control servo motor 20 so that arm 12 has a constant resistive torque applied thereto in the clockwise and counterclockwise directions, respectively, regardless of the force applied by the user, after the threshold in the respective direction has been overcome. In this manner, during the concentric torque mode, the resistive torque of arm 12** is controlled. As with the isokinetic mode of operation, the torque mode is operative for applied loads in the range of 0–400 ft.-lbs.

As discussed previously, during the eceentric mode of operation, arm 12 moves in a direction against the force applied by the user. Accordingly, an inverter 114 is inserted between proportional rate drive limiter circuit 52 and switch terminal **28*e*, which inverts the signal from proportional rate drive limiter circuit 52** in the eccentric mode to provide the aforementioned operation.

For the oscillation mode, an oscillator 116 is connected to switch terminal **28*d* and supplies a desired oscillation signal thereto. The oscillation signal is controlled by means of adjustable knob 26** on the control panel. The oscillation mode has particular applicability in rehabilitation where it is desired to provide a continuous flexion and extension of a limb so as to exercise the same without the user applying any force.

The output of oscillator 116 is connected with an output of a range of motion circuit 118, which will be discussed in greater detail hereinafter, so as to tie the zero position of the oscillator to the zero position of arm 12. In this regard, the output of range of motion circuit 118 functions as a position servo.

Range of motion circuit 118 is provided to control the angular range of motion of arm 12. In this regard, angular movement of arm 12 causes an associated potentiometer 120 to produce a voltage corresponding to the angular position of arm 12.

Range of motion circuit 118 includes a clockwise limit circuit 122 comprised of an amplifier 124 supplied with the signal from potentiometer 120 through an unity gain amplifier 126 at one input thereof, and its other input supplied with a voltage from a clockwise limit potentiometer 128 which is set by a control knob **25*a* on the control panel. In like manner, a counterclockwise limit circuit 130 is comprised of an amplifier 132 supplied at one input thereof with the output of unity gain amplifier 126 and at its other input with a voltage from a clockwise limit potentiometer 134, which is set by a control knob 25*b*. Potentiometers 128 and 134 are provided to control the angular range of motion of arm 12. Amplifiers 124 and 132** may be of the type 311 amplifier. All other amplifiers not specifically designated may be of the type 741 amplifier.

In accordance with the present invention, PWM amplifier 72 has a clockwise limit input 136 supplied with the output of amplifier 124 through a contact CR124. When the angular extent of arm 12 is reached in the clockwise direction, contact CR124 is closed, and supplies a logic level "1" signal to a clockwise limit input (not shown) of PWM amplifier 72 so that servo motor prevents arm 12 from exceeding its clockwise limit, that is, PWM amplifier 72 is inhibited. In like manner, PWM amplifier 72 has a counterclockwise limit input (not shown) supplied with the output of amplifier 132 through a contact CR132. When the angular extent of arm 12 is reached in the counterclockwise direction, contact CR132 is closed, and a logic level "1" signal is supplied to counterclockwise limit input 138 of PWM amplifier 72 so that servo motor prevents arm 12 from exceeding its counterclockwise limit.

The signal from potentiometer 120 is also supplied through unity gain amplifier 126 to a position servo amplifier 140 having its output connected with the output of oscillator 116 so as to tie the zero position of the oscillation signal to the zero position of arm 12, as aforementioned.

The output of unity gain amplifier 126 is also supplied to an output terminal 127 which can be supplied to any suitable monitoring device for measuring the angular range of motion.

Figure 5:
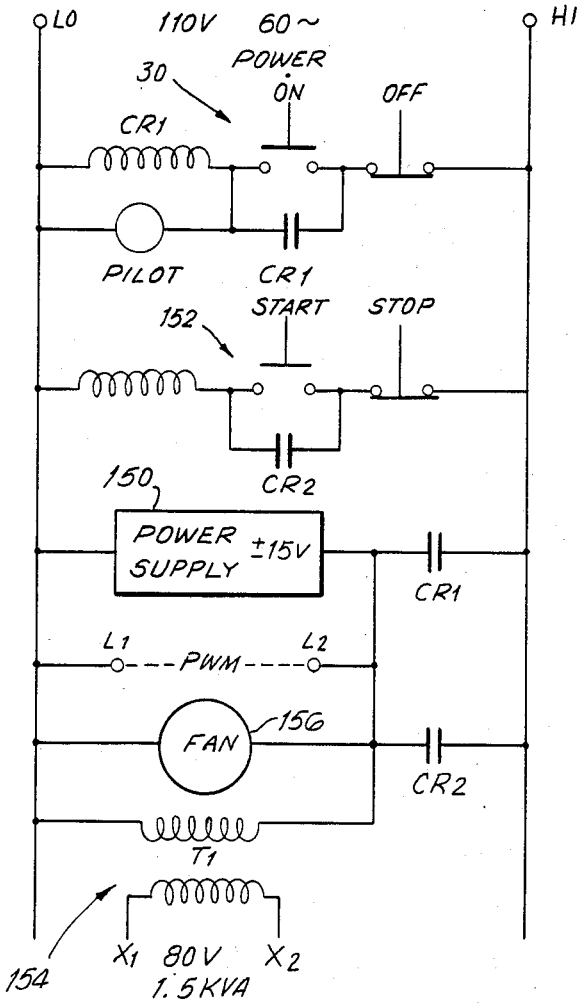
FIG. 5 is a circuit wiring diagram of various controls for the circuit of FIG. 4.

Referring now to FIG. 5, there is shown a power supply 150 for the above apparatus for supplying voltages of +15 volts and −15 volts to the circuitry of FIG. 4. As shown in FIG. 5, power supply 150 is connected to the circuitry of FIG. 4 when the ON/OFF switch 30 is activated. More particularly, when switch 30, which is a momentary contact switch, is turned ON, contact CR1 latches and maintains switch 30 in the ON condition. At the same time, contact CR1 associated with power supply 150 is closed.

As shown in FIG. 5, a START switch 152 is provided in order to start operation of the apparatus, and has a contact CR2 associated therewith, which is closed when the apparatus is started. A contact CR2 associated with circuit 64 is also operative at such time, as aforementioned.

PWM amplifier 72 is supplied with the 110 volt, 60 cycle supply across terminals $L_1$ and $L_2$ thereof, when contacts CR1 and CR2 associated therewith, as shown in FIG. 5, are closed. A transformer 154 is also operative at such time and supplies an appropriate signal across terminal $x_1$ and $x_2$ of PWM amplifier 72. Also, a fan 156 is operative only when PWM amplifier 72 is operative.

Accordingly, unlike the aforementioned prior art, the muscle exercise and rehabilitation apparatus 10 according to the present invention can be used in an isokinetic, constant torque, neutral, oscillation or eccentric mode in which either the velocity or resistive torque is smoothly regulated in both directions during operation thereof. In addition, a true velocity servo operation is achieved by the feedback circuitry herein for both directions, for flexion and extension, as well as for concentric and eccentric muscle contractions which can be accurately and readily controlled. Further, the apparatus provided herein is greatly simplified over that of prior art apparatus and provides a compact, inexpensive and novel arrangement thereover.

In order to better exemplify the present invention, the following values ean be used for the resistors and capacitors of FIG. 4:

| RESISTOR | RESISTANCE (Ω) |
|---|---|
| G1 Strain Gauge | 350 |
| G2 Strain Gauge | 350 |
| G3 Strain Gauge | 350 |
| G4 Strain Gauge | 350 |
| R5 | 500 |
| R6 | 100K |
| R7 | 500 |
| R8 | 820K |
| R9 | 40 |
| R10 | 10K |
| R11 | 150K |
| R12 | 10K |
| R13 | 10K |
| R14 | 2.7K |
| R15 | 100K |
| R16 | 10K |
| R17 | 1K |
| R18 | 10K |
| R19 | 4.7K |
| R20 | 3.3M |
| R21 | 10K |
| R22 | 1K |
| R23 | 240K |
| R24 | 240K |
| R25 | 10K |
| R26 | 5.1K |
| R27 | 10K |
| R27a | 10K |
| R28 | 10K |
| R29 | 500K |
| R30 | 10K |
| R31 | 5.1K |
| R32 | 1K |
| R33 | 5.1K |
| R34 | 30K |
| R35 | 2K |
| R36 | 4.9K |
| R37 | 5.1K |
| R38 | 30K |
| R39 | 2K |
| R40 | 4.9K |
| R41 | 10K |
| R42 | 100K |
| R43 | 100K |
| R44 | 10K |
| R45 | 100K |
| R46 | 100K |
| R47 | 5.1K |
| R48 | 10K |
| R49 | 10K |
| R50 | 10K |
| R51 | 50K |
| R52 | 50K |
| R53 | 10K |
| R54 | 10K |
| R55 | 50K |
| R56 | 50K |

-continued

| RESISTOR | RESISTANCE (Ω) |
|---|---|
| R57 | 10K |
| R58 | 10K |
| R59 | 5.1K |
| R60 | 10K |
| R61 | 10K |
| R62 | 10K |
| R63 | 10K |
| R64 | 5.1K |
| R65 | 10K |
| R66 | 10K |
| R67 | 10K |
| R68 | 50K |
| R69 | 50K |
| R70 | 10K |
| R71 | 10K |
| R72 | 50K |
| R73 | 50K |
| R74 | 10K |
| R75 | 10K |
| R76 | 50K |
| R77 | 4.7K |
| R78 | 10K |

| CAPACITOR | CAPACITANCE (F.) |
|---|---|
| C1 | .2μ* |
| C2 | .2μ* |
| C3 | .2μ* |
| C4 | .2μ* |
| C5 | .01μ |
| C6 | 68p |
| C7 | 1μ |
| C8 | 1μ |
| C9 | .47μ |
| C10 | .47μ |

*Ceramic Dip Type

Having described a specific preferred embodiment of the invention with reference to the accompanying drawings, it is to be understood that the present invention is not limited to that precise embodiment, and that various changes and modifications may be effected therein by one of ordinary skill in the art without departing from the spirit and scope of the present invention as defined by the appended claims.

What is claimed is:

1. Apparatus for exercising and rehabilitating muscles in a limb of a user, comprising:

movable arm means against which a force can be applied;

sensing means for sensing said force applied to said arm means and for producing a load signal corresponding thereto;

tachometer means for producing a velocity signal corresponding to the velocity of said arm means;

servo motor means coupled to said arm means for moving said arm means in opposite directions for both flexion and extension, respectively, of said limb of said user during a single exercise; and closed loop velocity servo feedback means for controlling said motor means in response to said load signal and said velocity signal to selectively move said arm means, with a constant torque or a regulated velocity, in opposite directions for both flexion and extension, respectively, of said limb.

2. A muscle exercise and rehabilitation apparatus comprising:

movable arm means against which a force can be applied;

servo motor means coupled to said arm means;

sensing means for sensing said force applied to said arm means and for producing a load signal corresponding thereto;

tachometer means for producing a velocity signal corresponding to the velocity of said arm means;

closed loop velocity servo feedback means for controlling said motor means in response to said load signal and said velocity signal to at least one of provide a constant torque to and regulate the velocity of said arm means, regardless of the force applied to said arm means; and said feedback means including amplifier means for amplifying said load signal to produce a control signal; torque control means responsive to said control signal for modifying said control signal to produce a modified control signal when said arm means has said constant torque applied thereto; speed clamp means responsive to said control signal for modifying said control signal to produce a modified control signal when said arm means has its velocity regulated; amplifier means for producing an error signal in response to said velocity signal and said modified control signal to control said motor means to at least one of apply said constant torque to said arm means and regulate the velocity of said arm means.

3. Apparatus according to claim 2 in which said amplifier means includes linear amplifier means for producing a linear amplified signal in response to said load signal and high gain amplifier means for producing a high gain amplified signal as said control signal in response to the linear amplified signal from said linear amplifier means.

4. Apparatus according to claim 3 in which said high gain amplifier means includes resistive feedback means and said speed clamp means is connected in parallel thereto to vary the gain of said high gain amplifier means when the speed of movement of said arm means is at least equal to a predetermined speed setting set by said speed clamp means so as to limit movement of said arm means to a predetermined speed.

5. Apparatus according to claim 4; in which said speed clamp means includes first and second variable voltage supply means for use during concentric operation, first amplifier means supplied with said high gain amplified signal and a signal from said first variable voltage supply means for supplying a first output signal to said high gain amplifier means during concentric operation to regulate the velocity of said arm means in a first direction and second amplifier means supplied with said high gain amplified signal and a signal from said second variable voltage supply means for supplying a second output signal to said high gain amplifier means during concentric operation to regulate the velocity of said arm means in a second direction opposite to said first direction.

6. Apparatus according to claim 5; in which said speed clamp means includes third variable voltage supply means, said first amplifier means regulates the velocity of said arm means during eccentric operation in said first direction in response to said high gain amplified signal and a signal from said third variable voltage supply means and said second amplifier means regulates the velocity of said arm means during eccentric operation in said second direction in response to said high gain amplified signal and a signal from said third variable voltage supply means.

7. Apparatus according to claim 4; further including switch means connected between said high gain amplifier means and said speed clamp means for supplying said high gain amplified signal to said speed clamp means when it is desired that said servo motor means regulate the velocity of said arm means.

8. Apparatus according to claim 3; in which said torque control means includes contact means connected to said high gain amplifier means for grounding said linear amplified signal, and amplifier means supplied with said linear amplified signal for controlling said contact means to ground said linear amplified signal when the load applied to said arm means is less than a predetermined threshold level determined by said torque control means.

9. Apparatus according to claim 8; in which said torque control means includes variable voltage supply means for setting said predetermined threshold level.

10. Apparatus according to claim 9; in which said contact means includes a first contact and a second contact connected between ground and said high gain amplifier means, said variable voltage supply means includes a first variable voltage supply and a second variable voltage supply for use during concentric operation, and said amplifier means of said torque control means includes a first amplifier supplied with said linear amplified signal and a signal from said first variable voltage supply for controlling said first contact during concentric operation to ground said linear amplified signal only when the load applied to said arm means in a first direction is less than a first predetermined threshold level set by said first variable voltage supply and a second amplifier supplied with said linear amplified signal and a signal from said second variable voltage supply for controlling said second contact during concentric operation to ground said linear amplified signal only when the load applied to said arm means in a second direction opposite to said first direction is less than a second predetermined threshold level set by said second variable voltage supply.

11. Apparatus according to claim 10; in which said variable voltage supply means includes a third variable voltage supply, and said first amplifier controls said first and second contacts during eccentric operation to ground said linear amplified signal only when the load applied to said arm means is less than a predetermined threshold level set by said third variable voltage supply, in response to said linear amplified signal and a signal from said third variable voltage supply.

12. Apparatus according to claim 10; in which said torque control means further includes a third contact connected between ground and said high gain amplifier means so that said torque control means is operative only when it is desired that said servo motor means provide a constant torque to said arm means.

13. Apparatus according to claim 3; in which said feedback means further includes multiplier means for multiplying the modified control signal by a ramp signal to prevent abrupt changes in the control of said arm means due to transients in the control signal.

14. Apparatus according to claim 3; in which said feedback means includes proportional rate drive limiter means connected between said high gain amplifier means and said servo motor means for preventing undesirable oscillations in said motor means.

15. Apparatus according to claim 2; in which said amplifier means for producing said error signal includes a pulse width modulated amplifier.

16. Apparatus for exercising and rehabilitating muscles in a limb of a user, comprising:

movable arm means against which a force can be applied;

sensing means for sensing said force applied to said arm means and for producing a load signal corresponding thereto;

tachometer means for producing a velocity signal corresponding to the velocity of said arm means;

servo motor means coupled to said arm means for moving said arm means in opposite directions for both flexion and extension, respectively, of said limb of said user during a single exercise; and closed loop velocity servo feedback means for controlling said motor means in response to said velocity signal and one of said load signal and said oscillation signal to move said arm means, with a constant torque or a regulated velocity, in opposite directions for both flexion and extension, respectively, of said limb.

17. A muscle exercise and rehabilitation apparatus comprising:

movable arm means against which a force can be applied;

servo motor means coupled to said arm means;

sensing means for sensing said force applied to said arm means and for producing a load signal corresponding thereto;

tachometer means for producing a velocity signal corresponding to the velocity of said arm means;

oscillator means for producing an oscillation signal;

closed loop velocity servo feedback means for controlling said motor means in response to said velocity signal and one of said load signal and said oscillation signal to at least one of provide a constant torque to and regulate the velocity of said arm means, regardless of the force applied to said arm means; and said feedback means including amplifier means for amplifying said load signal to produce a control signal; torque control means responsive to said control signal for modifying said control signal to produce a modified control signal when said arm means has said constant torque applied thereto; speed clamp means responsive to said control signal for modifying said control signal to produce a modified control signal when said arm means has its velocity regulated in an isokinetic mode of operation; amplifier means for producing an error signal in response to said velocity signal and one of said modified control signal and said oscillation signal to control said motor means to at least one of provide a constant torque to and regulate the velocity of said arm means, regardless of the force applied to said arm means; and switch means for selectively supplying one of said modified control signal and said oscillation signal to said amplifier means which produces said error signal.

18. Apparatus according to claim 17; further comprising contact means responsive to said switch means for enabling said speed clamp means only when it is desired to have the velocity of said arm means regulated in said isokinetic mode of operation, and for enabling said torque control means only when it is desired to have said constant torque applied to said arm means.

19. Apparatus according to claim 17; in which said switch means supplies said control signal to said amplifier means which produces said error signal, and further comprising contact means controlled by said switch means when the latter supplied said control signal to said amplifier means to prevent said torque control circuit and said speed clamp circuit from modifying said control signal, so as to provide a neutral mode of operation.

20. Apparatus according to claim 17; in which said feedback means includes multiplier means connected between said switch means and said amplifier means which produces said error signal, for multiplying the signal supplied by said switch means to said amplifier means by a ramp signal to prevent abrupt changes in the control of said arm means due to transients in the control signal.

21. Apparatus for exercising and rehabilitating muscles in a limb of a user, comprising:

movable arm means against which a force can be applied by said user;

sensing means for sensing said force applied to said arm means and for producing a load signal corresponding thereto;

tachometer means for producing a velocity signal corresponding to the velocity of movement of said arm means;

servo motor means coupled to said arm means for moving said arm means in opposite directions for both flexion and extension, respectively, of said limb of said user during a single exercise; and closed loop velocity servo feedback means for controlling said motor means in response to said load signal and said velocity signal to move the arm means in opposite directions for both flexion and extension, respectively, of said limb, at a regulated velocity.

22. Apparatus according to claim 21; further including switch means for controlling said feedback means to control said servo motor means to move said arm means in a concentric mode of operation for both flexion and extension of said limb.

23. Apparatus according to claim 21; further including switch means for controlling said feedback means to control said servo motor means to move said arm means in an eccentric mode of operation for both flexion and extension of said limb.

24. Apparatus according to claim 21; further including switch means for selectively controlling said feedback means to control said servo motor means to move said arm means in a concentric mode of operation of both flexion and extension of said limb or an eccentric mode of operation for both flexion and extension of said limb.

25. Apparatus according to claim 21; in which said feedback means includes speed clamp means responsive to said load signal for modifying said load signal to produce a modified load signal; and means for producing an error signal in response to said velocity signal and said modified load signal to control said motor means to move the arm means in opposite directions for both flexion and extension, respectively, of said limb, at a regulated velocity.

26. Apparatus according to claim 21; in which said feedback means includes amplifier means for amplifying said load signal to produce a control signal; speed clamp means responsive to said control signal for modifying said control signal to produce a modified control signal; and means for producing an error signal in response to said velocity signal and said modified control signal to control said motor means to move the arm means in opposite directions for both flexion and extension, respectively, of said limb, at a regulated velocity.

27. Apparatus according to claim 26; in which said amplifier means includes linear amplifier means for producing a linear amplified signal in response to said load signal and high gain amplifier means for producing a high gain amplified signal as said control signal in response to the linear amplified signal from said linear amplifier means.

28. Apparatus according to claim 27; in which said high gain amplifier means includes resistive feedback means and said speed clamp means is connected in parallel thereto to vary the gain of said high gain amplifier means when the speed of movement of said arm means is at least equal to a predetermined speed setting set by said speed clamp means so as to limit movement of said arm means to a predetermined speed.

29. Apparatus according to claim 28; in which said speed clamp means includes first and second variable voltage supply means for use during concentric operation, first amplifier means supplied with said high gain amplified signal and a signal from said first variable voltage supply means for supplying a first output signal to said high gain amplifier means during concentric operation to regulate the velocity of said arm means in a first direction and second amplifier means supplied with said high gain amplified signal and a signal from said second variable voltage supply means for supplying a second output signal to said high gain amplifier means during concentric operation to regulate the velocity of said arm means in a second direction opposite to said first direction.

30. Apparatus according to claim 29; in which said speed clamp means includes third variable voltage supply means, said first amplifier means regulates the velocity of said arm means during eccentric operation in said first direction in response to said high gain amplified signal and a signal from said third variable voltage supply means and said second amplifier means regulates the velocity of said arm means during eccentric operation in said second direction in response to said high gain amplified signal and a signal from said third variable voltage supply means.

31. Apparatus according to claim 27; in which said feedback means further includes multiplier means for multiplying the modified control signal by a ramp signal to prevent abrupt changes in the control of said arm means due to transients in the control signal.

32. Apparatus according to claim 27; in which said feedback means includes proportional rate drive limiter means connected between said high gain amplifier means and said servo motor means for preventing undesirable oscillations in said motor means.

33. Apparatus according to claim 26; in which said amplifier means for producing said error signal includes a pulse width modulated amplifier.

34. Apparatus according to claim 21; in which said sensing means includes strain gauge means mounted on said arm means for detecting bending of the latter.

35. Apparatus according to claim 34; in which said sensing means further includes load cell means for producing said load signal corresponding to the load applied to said arm means in response to said strain gauge means.

36. Apparatus according to claim 21; in which said servo motor means has an output shaft, and further including gear reducer means connected between said output shaft and said arm means for driving the latter.

37. Apparatus according to claim 21; further comprising range of motion control means for controlling the position of said arm means, said range of motion control means including position sensing means for sensing the position of said arm means and producing a position signal in response thereto, and position control means for controlling the position of said arm means in response to said position signal.

38. Apparatus according to claim 37; in which said position control means includes first and second variable voltage supply means, first amplifier means for limiting movement of said arm means to a first limit in a first direction in response to a signal from said first variable voltage supply means and said position signal, and second amplifier means for limiting movement of said arm means to a second limit in a second direction opposite to said first direction in response to a signal from said second variable voltage supply means and said position signal.

39. Apparatus according to claim 21; further comprising inverter means for inverting said load signal supplied to said feedback means during eccentric operation.

40. Apparatus for exercising and rehabilitating muscles in a limb of a user for both flexion and extension of said limb, comprising:

movable arm means against which a force can be applied by said user;

sensing means for sensing said force applied to said arm means and for producing a load signal corresponding thereto;

tachometer means for producing a velocity signal corresponding to the velocity of movement of said arm means;

servo motor coupled to said arm means for moving said arm means in opposite directions for both flexion and extension, respectively, of said limb of said user during a single exercise; and closed loop velocity servo feedback means for selectively controlling said motor means in response to said load signal and said velocity signal to move said arm means in opposite directions, in a concentric mode of operation for both flexion and extension of said limb or an eccentric mode of operation for both flexion and extension of said limb, at a regulated velocity.

41. Apparatus for exercising and rehabilitating muscles in a limb of a user for both flexion and extension of said limb, comprising:

movable arm means against which a force can be applied by said user;

sensing means for sensing said force applied to said arm means and for producing a load signal corresponding thereto;

tachometer means for producing a velocity signal corresponding to the velocity of movement of said arm means;

servo motor means coupled to said arm means for moving said arm means in opposite directions for both flexion and extension, respectively, of said limb of said user during a single exercise; and closed loop velocity servo feedback means for selectively controlling said motor means in response to said load signal and said velocity signal to move said arm means in opposite directions, in a concentric mode of operation for both flexion and extension of said limb or an eccentric mode of operation for both flexion and extension of said limb, with a constant torque.

* * * * *